United States Patent [19]

Treitz

[11] Patent Number: 4,771,834

[45] Date of Patent: Sep. 20, 1988

[54] PERCUSSION DRILL BIT FOR ROCK PERFORATORS

[76] Inventor: Siegfried Treitz, Hagenerstr. 60, D-5883 Kierspe 1, Fed. Rep. of Germany

[21] Appl. No.: 5,436

[22] PCT Filed: Mar. 8, 1986

[86] PCT No.: PCT/DE86/00097

§ 371 Date: Nov. 13, 1986

§ 102(e) Date: Nov. 13, 1986

[87] PCT Pub. No.: WO86/05542

PCT Pub. Date: Sep. 25, 1986

[51] Int. Cl.[4] ..... E21B 10/38

[52] U.S. Cl. ..... 175/415; 175/417

[58] Field of Search ..... 175/398, 400, 401, 410, 175/414, 415, 417

[56] References Cited

U.S. PATENT DOCUMENTS

| | | | |
|---|---|---|---|
| 2,484,365 | 10/1949 | Wilsher | 255/64 |
| 3,521,716 | 7/1970 | Fisher | 175/417 |
| 3,583,504 | 6/1971 | Aalund | 175/410 |
| 3,951,220 | 4/1976 | Phillips, Jr. | 175/410 |
| 4,096,917 | 6/1978 | Harris | 175/410 |
| 4,202,421 | 5/1980 | Pinck | 175/398 |
| 4,203,496 | 5/1980 | Baker, III | 175/410 |
| 4,471,845 | 9/1984 | Jurgens | 175/410 |

FOREIGN PATENT DOCUMENTS

| | | | |
|---|---|---|---|
| 2528003 | 1/1977 | Fed. Rep. of Germany . | |
| 2633779 | 2/1978 | Fed. Rep. of Germany | 175/410 |
| 3225050 | 1/1984 | Fed. Rep. of Germany . | |
| 8406901 | 5/1984 | Fed. Rep. of Germany . | |
| 3408225 | 9/1985 | Fed. Rep. of Germany . | |
| 1515221 | 3/1968 | France . | |

OTHER PUBLICATIONS

Mining Magazine, Nov. 1974, p. 383.

*Primary Examiner*—Stephen J. Novosad
*Assistant Examiner*—Terry L. Melius
*Attorney, Agent, or Firm*—Herbert Dubno

[57] ABSTRACT

Percussion drill bit for rock perforators is provided whose frontal face is covered by a plurality of hard-metal studs, whereby a plurality of studs are positioned to form a group, there being several of these groups present and each of the so-called groups being at a distance from one another at least circumferentially and separated through circulation-medium channels, and further provided with at least one axial center channel located roughly in a center of the frontal face and opening into the circulation-medium channels, characterized in that each group consists of only one row of studs (1) arranged on sloped protruding drilling facets (4), in that the drilling facets (4) run against the rotation direction (A) of the drill bit, at an angle with respect to the radius, and in that the circulation-medium channels (2) formed in the frontal face widen starting from the center of the drill bit, radially towards the outside.

8 Claims, 3 Drawing Sheets

PERCUSSION DRILL BIT FOR ROCK PERFORATORS

CROSS REFERENCE TO RELATED APPLICATIONS

This application is a National Phase Application corresponding to PCT/DE86/00097 filed Mar. 8, 1986 and based, in turn, upon a German National Application P3510048.6 of Mar. 20, 1985.

FIELD OF THE INVENTION

The invention relates to a percussion drill bit for grinding rock and stone.

BACKGROUND OF THE INVENTION

Percussion drill bits for rock perforators may have a frontal face covered by a plurality of hard-metal studs, several such studs being arranged in a group. The resulting groups maybe at a distance from each other at least in circumferential direction and separated from each other by channels for the circulation medium. Further, the bit may be provided with at least one axial channel opening into the channels and located approximately centrally within the frontal face, serving as an outlet for the circulation medium.

Such a drill bit is known for instance from German open application DE OS No. 27 33 300.

Indeed, in the case of this already-known two-part drill bit, cutting inserts, for instance in the shape of hard-metal studs are provided in groups, whereby the groups are separated from each other through circulation-medium channels running radially, respectively in given cases, slightly curved in the direction of rotation.

The studs are indeed arranged in a multiple setting on an island, protruding with respect to the circulation-medium channels so that larger lumps of detritus can get stuck between the studs. This results in a relatively long drilling time for corresponding advances, because these lumps must first be comminuted before they can be evacuated by the circulation-medium through the circulation-medium channels. The circulation-medium channels do not serve for the exhaust gas evacuation. Neither do they help in the evacuation of the detritus, this evacuation being performed solely by the exhaust gas. Furthermore, the studs arranged in this manner can be reground only with difficulty, since the neighboring studs mutually impede their regrinding.

For the mounting of such drill bits to rock perforators it is common, in the case of the so-called sinker drills, to introduce a slotted shaft in a holding member. Thereby the drive operates counterclockwise. Alternatively it is also possible, in the case of surface drills, to provide the shaft with an inner threading, which can then be threaded to a nipple. This embodiment turns clockwise.

The individual arrangement of studs protruding from the main body of the drill bit is known from the German open application No. 26 33 779. This arrangement facilitates the regrinding of the studs, but obstructs the evacuation of the detritus. Moreover, larger lumps of detritus can continue to get stuck between the studs.

OBJECT OF THE INVENTION

The object of the invention is to provide a percussion drill bit of the afore-described kind, wherein, on the one hand, it is relatively easy to regrind the studs and, on the other hand, the sticking of larger lumps of detritus between the studs is largely prevented and the evacuation of the detritus is promoted.

SUMMARY OF THE INVENTION

In order to attain the object, the invention provides that each of the groups consist of one row of studs, arranged on protruding drilling facets.

With to this type of construction, it is possible, on the one hand, to regrind the studs of each stud row relatively easily, whereby each of the stud surfaces which are essential for the comminuting of the rock is easily accessible. On the other hand, larger lumps of detritus can practically not get stuck between the studs. On the contrary, these lumps can be immediately deflected radially outwardly and evacuated through the circulation-medium channels. The detritus is transported in the free spaces between the drilling facets and evacuated due to the action of the exhaust gases of the rock perforator, particularly of the drill hammer.

It is particularly advantageous when the drilling facets run contrary to the direction of rotation of the drill bit, inclined with respect to the radius.

This way, the removal of the detritus is assisted by the rotational movement of the drill bit, since the detritus can be carried radially outwardly solely due to the rotation of the drill bit, without the assistance of the exhaust gases.

It is thereby particularly advantageous when the drill facets are curved.

In order to further facilitate the evacuation of the detritus, the circulation-medium channels provided in the frontal face are preferably built so that they become increasingly wider, from the center of the drill, in radially outward direction.

Further, the invention provides that the frontal face is conically shaped.

Alternatively, or in addition, the frontal face can be dome-shaped.

In a preferred further embodiment, the intermediate area between the frontal face and the shaft are provided with channels running axially and that the circulation-medium channels of the frontal face discharge into these axial channels.

The arrangement of axially running channels in the intermediate area between the frontal face and the shaft is known per se, for instance, from the German open application No. 26 33 779. The special arrangement of the channels is indeed very advantageous, since an excellent communication results between the channels in the frontal face and the axially running channels.

In a preferred further development, the axial channels are lodged deeply in the main body of the drill bit, whereby they partially cross the circulation-medium channels of the frontal face, and, in some instances, the drilling facets.

Due to the fact that the channels are positioned as far as possible radially inwardly, a particularly rapid removal of the detritus is promoted. Altogether, the construction according to the invention insures a higher performance without a higher degree of wear. With reduced wear the same drilling depth can be reached in a shorter time than possible with the constructions according to the state of the art. Thereby, a lower load on the studs is possible. Also advantages is the improved regrinding of the studs, particularly because it can be done through simple means. Thus, due to the arrangement of the studs, the regrinding can be done especially at the flanks of the studs which lie at the lateral edges of the drill facets. Since the grinding operation is this way not performed radially, but more in the way of a secant or the like, the formation of a radial chisel edge is avoided. The reground drill bit which results is only slightly prone to chatter and produces only extremely reduced vibrations. Hereby, the danger of stud breakage is considerably reduced.

Further it is preferred that between the axial channels, back-up teeth be provided, which face away from the frontal face axially outwardly. These back-up teeth break the back-running rock, which is necessary and advantageous especially when the drill bit has to be retracted from the bore hole.

In this respect, it is also advantageous that the back-up teeth be arranged on a base which is part of the main body of the bit and which tapers off laterally away from the frontal face and radially inwardly. It is particularly advantageous when the stud, which is radially the most extreme on each of the drill facets, is arranged on a drill bit portion formed by a back-up tooth.

In this manner, more support material is provided under the respective extreme stud during the advance of the drill bit, so that it is less exposed to breakage. Besides, due to the arrangement of the especially conically widening axial channels and to the back-up teeth, the so-called "propeller wear" is reduced. It is particularly advantageous to arrange on each drilling facet two or, at the most, three studs.

BRIEF DECRIPTION OF THE DRAWING

Embodiment examples according to the invention are represented in the drawing and subsequently described in detail:

The drawing shows:

FIG. 1 a first, very simple embodiment of a percussion drill bit in highly simplified, schematical representation;

FIG. 2 a top view of FIG. 1;

FIG. 3 a variant of FIG. 1;

FIG. 4 a top view of the variant according to FIG. 3;

FIG. 5 a further advantageous variant of FIG. 1; and

FIG. 6 a top view of the variant according to FIG. 5.

DETAILED DESCRIPTION

Figure 4:
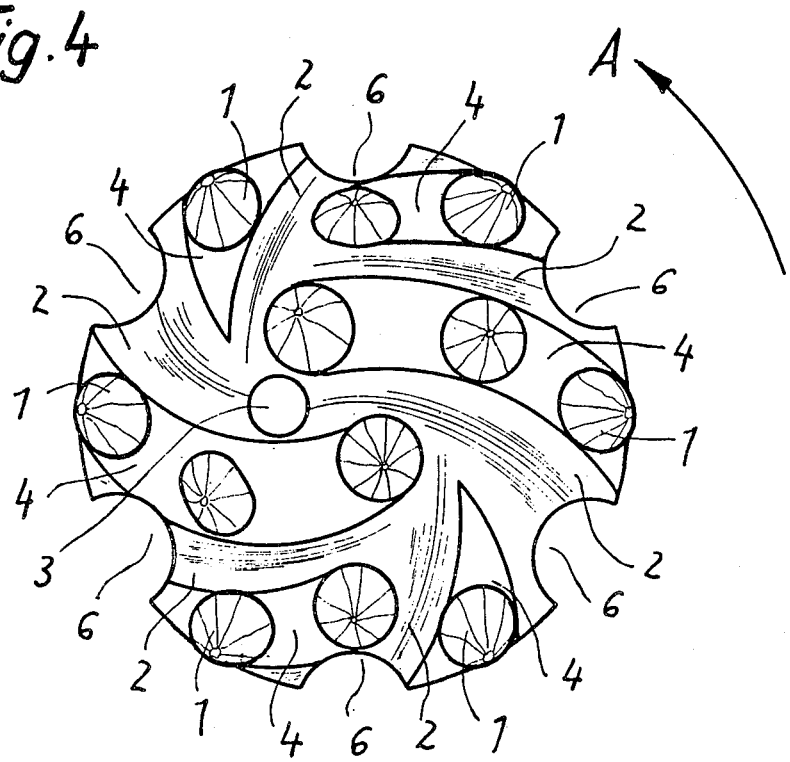

In all the embodiments a percussion drill bit is represented, which is provided with a slotted shaft (not shown) so that in each case they are counterclockwise rotating embodiments. The direction of rotation is indicated with the arrow A in the FIGS. 2, 4 and 6, respectively. The percussion drill bit for the rock perforator presents a plurality of hard-metal studs 1 on their frontal face, whereby several studs 1 are joined into a group of studs. These groups are at a distance from each other. They are spatially separated by circulation-medium channels. As a circulation-medium outlet for the exhaust gases of the perforator, an axial center channel 3 opening into the channels 2 provided roughly in the center of the frontal face.

The above-indicated groups are each formed by a row of studs 1, fastened to protruding drilling facets 4. The drilling facets 4 are arranged oppositely to the rotation direction A of the drill bit and inclined with respect to the radius. The simplest embodiment is illustrated in FIGS. 1 and 2.

According to FIGS. 3 to 6, the drilling facets 4, as well as the circulation-medium channels 2 are curved, whereby the curvature runs contrary to the direction of rotation A of the drill bit. In all the embodiments, the circulation-medium channels 2 formed in the frontal face get considerably wider, starting from the center of the drill bit, radially towards the outside.

Figure 1:
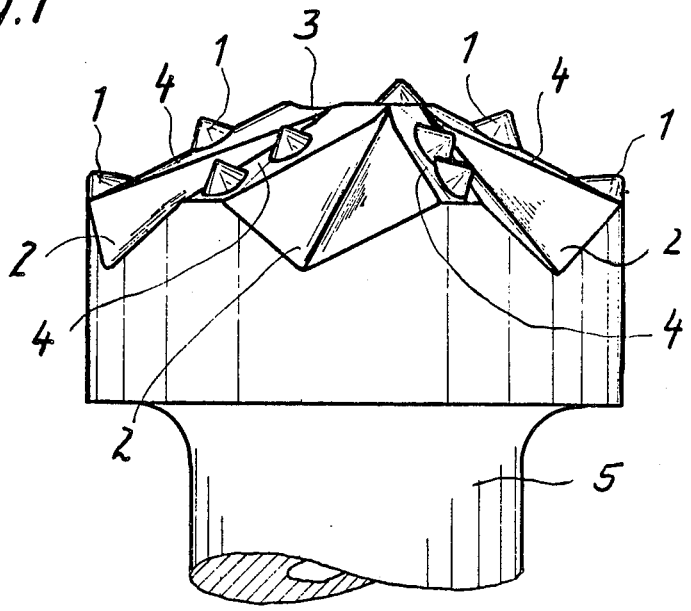
Figure 2:
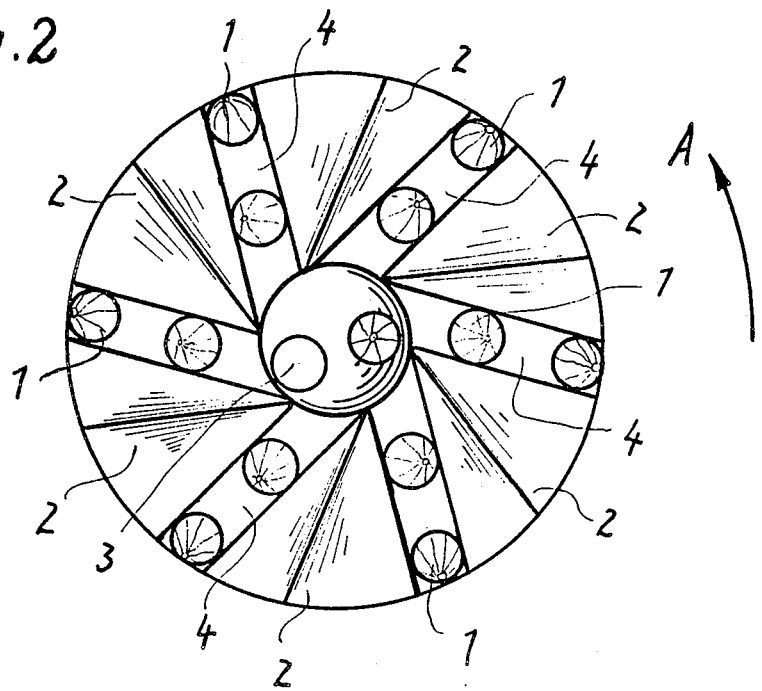
Figure 3:
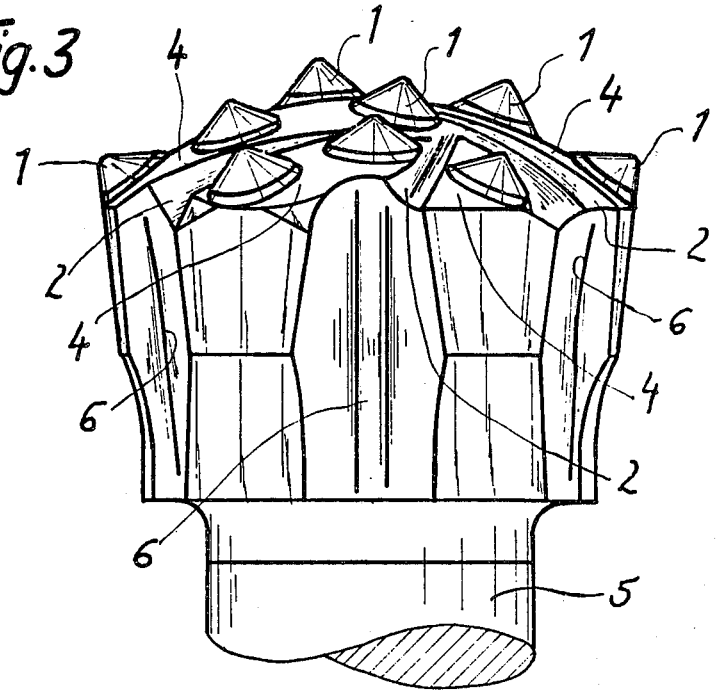

In the embodiment according to FIGS. 1 and 2, the frontal face of the drill bit is of frustoconical shape, while the frontal face of the embodiments according to FIGS. 3 to 6 is convexly dome-shaped.

In the embodiments according to FIGS. 3 to 6, axially running edge channels 6 are arranged in the transition area between the frontal face and the shaft 5, the circulation-medium channels 2 opening into channels 6. The axial edge channels 6 are thereby located as deeply as possible in the main body of the drill bit, whereby they partially cross the circulation-medium channels 2 of the frontal face, but also the drilling facets 4 (particularly in the embodiments according to FIGS. 5 and 6).

Figure 5:
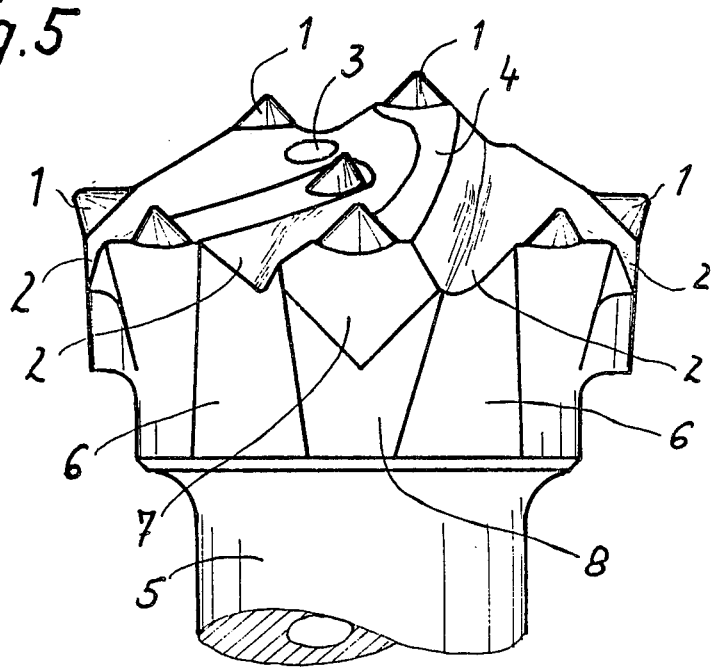
Figure 6:
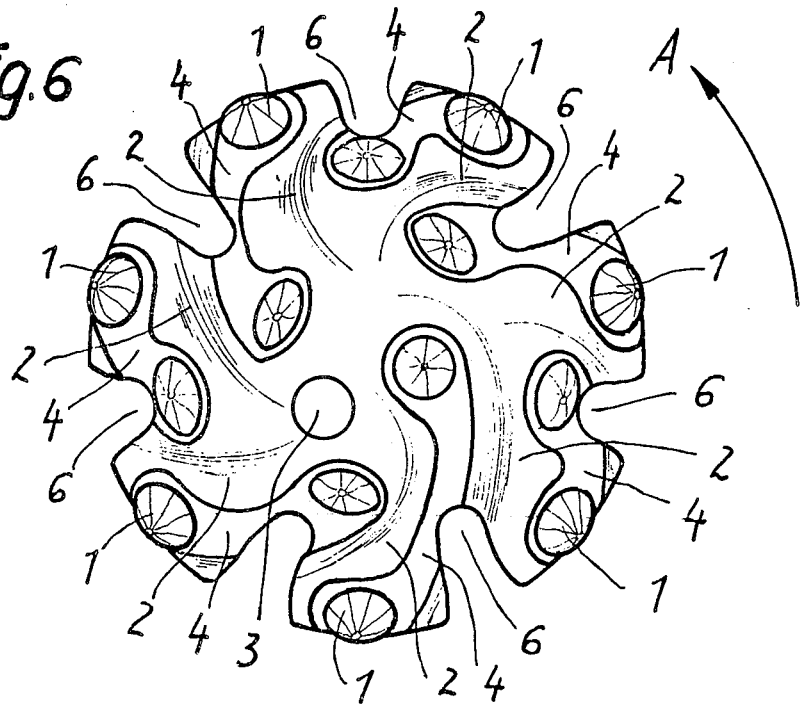

In the embodiment according to FIGS. 5 and 6, back-up teeth 7 are provided between the axial edge channels 6, which face away outwardly axially from the frontal face. The back-up cutting teeth 7 are arranged on a base 8 which is part of the drill body and which tapers off laterally from the frontal face and radially inwardly. The stud which is in the most extreme position, considered radially, of each drilling facet 4 is mounted on a drill bit portion formed by one back-up cutting tooth 7.

Preferably, on each drilling facet 4 two studs 1 are mounted. Depending on the direction and arrangement of the drilling facets, it can also be advantageous to arrange three studs 1 or also only one stud 1 on the drilling facet 4.

With the construction of the invention, one can achieve a high drilling performance with relatively low wear, as well as a long life of the drill bit with low energy consumption, since the detritus leaves the bottom of the bore hole in a much coarser state.

I claim:

1. A percussion drill bit for a rock perforator, comprising:

a drill shaft; and a drill body on said shaft and having a frontal face covered by a multiplicity of hard-metal studs in respective groups on respective drilling facets formed by said face, the groups being spaced from one another at least circumferentially by circulation-medium channels formed in said face between said facets, said face being further formed with an axial center channel located generally in a center of said frontal face and opening into said circulation-medium channels, each of said groups consisting of only a single row of said studs arranged on a respective sloped protruding one of said drilling facets, said drilling facets running against a direction of rotation of said bit at an angle with respect to respective radii of said bit, said circulation-medium channels widening from the center of said frontal face toward an outer periphery of said body, said body being further formed with deep axially extending edge channels between said frontal face and a region of said body adjoining said shaft, said edge channels opening into said circulation-medium channels while intersecting said circulation-medium channels and at least some of said drilling facets.

2. The percussion drill bit defined in claim 1, further comprising backup cutting teeth formed on said body between said axial edge channels and projecting outwardly and facing axially away from said frontal face.

3. The percussion drill bit defined in claim 2 wherein said backup cutting teeth are formed on a base constituting part of said body and set inwardly radially from said frontal face.

4. The percussion drill bit defined in claim 2 wherein each of said drilling facets is formed on a portion of said body provided with a respective backup cutting tooth.

5. The percussion drill bit defined in claim 2 wherein each of said drilling facets is provided with a maximum of three studs in the respective row.

6. The percussion drill bit defined in claim 2 wherein each of said drilling facets are curved.

7. The percussion drill bit defined in claim 2 wherein said frontal face is generally frustoconical.

8. The percussion drill bit defined in claim 2 wherein said frontal face is generally dome shaped.

* * * * *